United States Patent [19]

Thomas et al.

[11] Patent Number: 4,638,277

[45] Date of Patent: Jan. 20, 1987

[54] CIRCUIT BREAKER WITH BLOW OPEN LATCH

[75] Inventors: Glenn R. Thomas, Brighton Twp., Beaver County; Jere L. McKee, Scott Twp., Lawrence County, both of Pa.

[73] Assignee: Westinghouse Electric Corp., Pittsburgh, Pa.

[21] Appl. No.: 782,669

[22] Filed: Oct. 1, 1985

[51] Int. Cl.[4] ..... H01H 3/00

[52] U.S. Cl. ..... 335/190; 335/16; 335/194; 335/198; 335/200; 200/147 R

[58] Field of Search ..... 335/16, 6, 147, 195, 335/150, 190, 194, 198, 200; 200/147 R

[56] References Cited

U.S. PATENT DOCUMENTS 3,436,710 4/1969 Stokes ..... 335/190
3,564,184 2/1971 Gauthier ..... 200/244
4,480,242 10/1984 Castonguay ..... 335/194
4,553,119 11/1985 Castonguay ..... 335/16

*Primary Examiner*—E. A. Goldberg
*Assistant Examiner*—Lincoln D. Donovan
*Attorney, Agent, or Firm*—L. P. Johns

[57] ABSTRACT

An electric circuit breaker with blow open contact arm characterized by a pair of separable contacts one of which is mounted on a contact arm that is rotatably mounted on mounting bracket. The contacts maintain a repulsion magnetic force which operates to separate the contacts when a predetermined current overload occurs. A trip mechanism is connected to the mounting bracket or automatic opening of the contacts in response to a predetermined current overload condition. The contact arm comprising a cam and the mounting bracket comprising a cooperable cam follower whereby the contact arm is movable to an open contact independently of the mounting bracket.

4 Claims, 7 Drawing Figures

CIRCUIT BREAKER WITH BLOW OPEN LATCH

CROSS REFERENCE TO RELATED APPLICATIONS

This application is related to the copending applications Ser. No. 562,647, filed Dec. 19, 1983, entitled MOLDED CASE CIRCUIT BREAKER WITH AN APERTURED MOLDED CROSSBAR FOR SUPPORTING A MOVABLE ELECTRICAL CONTACT ARM of A. E. Maier; Ser. No. 714,652, filed Mar. 21, 1985, entitled MOLDED CASE CIRCUIT BREAKER WITH COMBINED POSITION INDICATOR AND HANDLE BARRIER of J. R. Farley and R. H. Flick; Ser. No. 756,489 filed July 18, 1985, entitled CURRENT LIMITING CIRCUIT BREAKER WITH ARC COMMUTATING STRUCTURE, of W. E. Beatly, J. L. McKee, G. R. Thomas, and Y. K. Chien; and Ser. No. 729,436, filed May 1, 1985, entitled CIRCUIT BREAKER WITH ARM LATCH FOR HIGH INTERRUPTING CAPACITY, of D. A. Leone and D. C. Marks, all assigned to the present assignee.

BACKGROUND OF THE INVENTION

1. Field of the Invention

This invention relates to circuit breakers and, more particularly, it pertains to a camming latch retainer for holding a contact arm in a required position.

2. Description of the Prior Art

Circuit breakers provide circuit protection for current distribution systems. Protection for an electrical circuit or system is provided against electrical overcurrent conditions, such as overload conditions as well as low and high level short circuit or fault current conditions.

An ingredient to the successful interruption of overcurrent conditions is the capacity of the circuit breaker's contact arm to unlatch and open as quickly as possible upon inception of a condition. A resisting force to contact arm unlatching is termed the "blow open" force. A disadvantage of relatively small circuit breakers has been the lack of means for maintaining a very low "blow open" force while also providing a consistent contact pressure necessary for reliable continuous current carrying operation.

SUMMARY OF THE INVENTION

In accordance with this invention, an electric circuit breaker is provided which comprises an electrically insulating housing having a base and cover, a circuit breaker unit within the housing and having a pair of separable contacts operable between open and closed positions, the circuit breaker unit including a releasable member, a trip mechanism movable in response to a predetermined current overload to release the releasable member, the circuit breaker unit including a contact arm carrying one of the contacts, the contacts maintaining a repulsion magnetic force which force is proportional to the square of the current load flowing through the contacts, mounting means mounting the contact arm for movement about a pivot upon actuation of the trip mechanism, the mounting means including spring biasing means for maintaining the contact arm in the contact in either open or closed positions, the spring biasing means including a coil spring and a cam follower, the contact arm comprising a cam over which the cam follower moves from a first to a second cam position when the contact arm moves in response to an increased repulsion magnetic force due to a short circuit current, and the trip mechanism actuating the circuit breaker unit to the open contact position causing the mounting means to rotate about the pivot and thereby move the contact arm from the second to the first cam position, whereby the circuit breaker unit is reset for manual closing of the contacts.

The advantage of the circuit breaker of this invention is that it comprises a mechanical cam latch which provides a low ratio of "blow open" force to contact force for the contact arm of the circuit breaker, thereby enabling the contact arm to open as quickly as possible during overcurrent fault conditions while providing consistent contact pressure necessary for continuous current carrying operation.

DESCRIPTION OF THE PREFERRED EMBODIMENT

Figure 1:
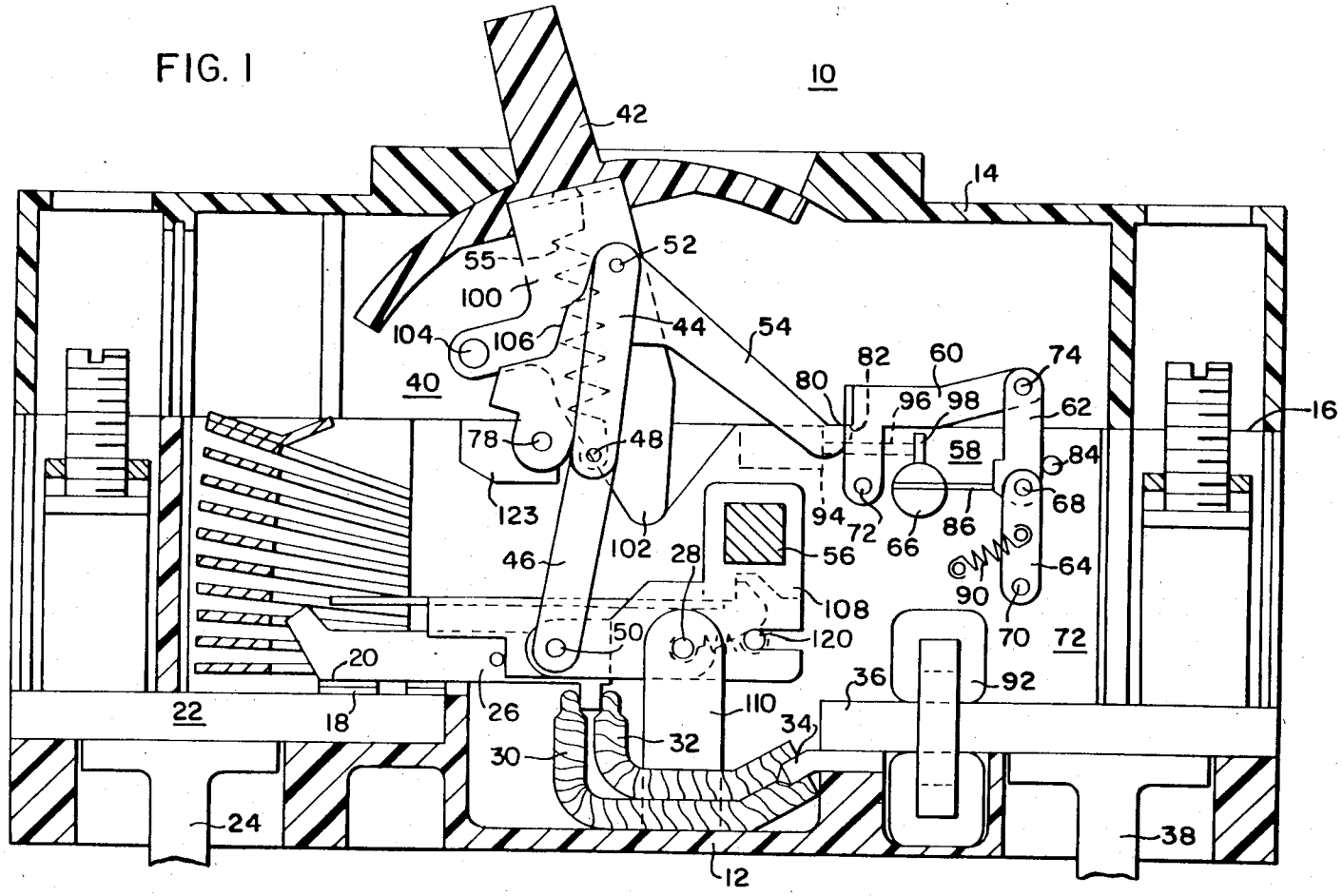
FIG. 1 is a vertical sectional view through a multiple pole circuit breaker shown in the closed contact position.

A molded case circuit breaker is generally indicated at 10 in FIG. 1 and it comprises a base 12 having a cover 14. The base and the cover are assembled at a parting line 16 and create an internal compartment in which circuit breaker apparatus is disposed which includes a fixed contact 18 and a movable contact 20. The fixed contact is mounted on a conductor 22 to which a stab 24 is connected.

The movable contact 20 is mounted on a contact carrying arm 26 which is pivotally mounted on pivot 28. A pair of flexible conductors, or shunts, 30, 32 extend from the arm 26 to a connector 34 of a conductor 36 which conductor is connected to a stab 38. Thus, a circuit through the circuit breaker extends from the stab 24 through the several parts 22, 18, 20, 26, 30, 32, 34, 36 to the stab 38.

An operating mechanism generally indicated at 40 is provided for opening and closing the contacts by means of a conventional toggle assembly which includes toggle links 44, 46 which are pivotally interconnected at pivot 48. Link 46 is pivotally connected at pivot 50 to the contact arm 26. The link 44 is pivotally connected at pivot 52 to a releasable arm or cradle 54. The toggle mechanism also includes a coil spring 55 in a conventional manner.

Opening of the contacts 18, 20 is accomplished either by the handle 42 or automatically in response to overcurrent conditions occurring in the circuit.

The contact arm 26 supports a crossbar 56 which is interconnected with contact arms in adjacent pole units of the three-pole circuit breaker 10 for opening and closing corresponding contacts similar to contacts 18, 20, simultaneously. Accordingly, when the operating mechanism 40 actuates the contact arm 26 between either open or closed positions, the contact arms in adjacent poles of the circuit breaker are moved correspondingly by the operating mechanism 40.

The circuit breaker 10 also comprises a latching device generally indicated at 58 and it comprises a latch lever 60, a pair of links 62, 64, and a trip bar 66. The links 62, 64 are pivotally interconnected at pivot 68 forming a toggle joint. The lower end of the link 64 is pivoted at 70 to a frame member 72 and the upper end of the link 62 is pivotally connected at 74 to the latch lever 60, which lever is pivoted at 76 to the frame 72.

In FIG. 1 the latching device 58 is disposed in the latched position of the cradle 54 which is pivotally mounted to the frame 72 at pivot 78. End 80 of the cradle 54 is retained in place by a surface 82 of the latch lever 60, which lever is retained in place by the links 62, 64 disposed in substantially aligned positions. The links 62, 64 are retained in that position against a stop pin 84 by pressure from a lever 86 extending from the trip bar 66. So long as the latching device 58 remains in the latched position with respect to the cradle 54, the circuit breaker may be opened only by movement of the handle 42 to the "off" position.

However, when in response to overcurrent conditions, such as a short circuit, the trip bar 66 is rotated clockwise to move the lever 86 from contact with the link 62, a bias spring 90 rotates the toggle link to the left, causing the latch lever 60 to rotate clockwise, and releasing the cradle 54 which rotates counterclockwise in response to pressure of spring 55. Thus, the circuit breaker 10 is tripped.

Automatic tripping of the circuit breaker occurs in response to overcurrent conditions which may operate at least one device, such as a bimetal, electromagnet, or a current transformer. For example, a current transformer 92 (FIG. 1) is disposed around the conductor 36. When a current exceeding a prescribed rating passes through the conductor 36, the current transformer 92 feeds an electronic trip unit (not shown) which, in turn, actuates a solenoid 94 having a plunger 96 which moves against a lever 98 for rotating the trip bar clockwise. Resetting of the circuit breaker 10 occurs by rotating the handle 42 (FIG. 1) clockwise to rotate an inverted U-shaped operating lever 100 about a pivot 102, causing a pin 104 on the lever to move against an edge 106 to rotate the cradle 54 clockwise until the end 80 is reengaged under surface 82 of the latch lever 80.

Figure 4:
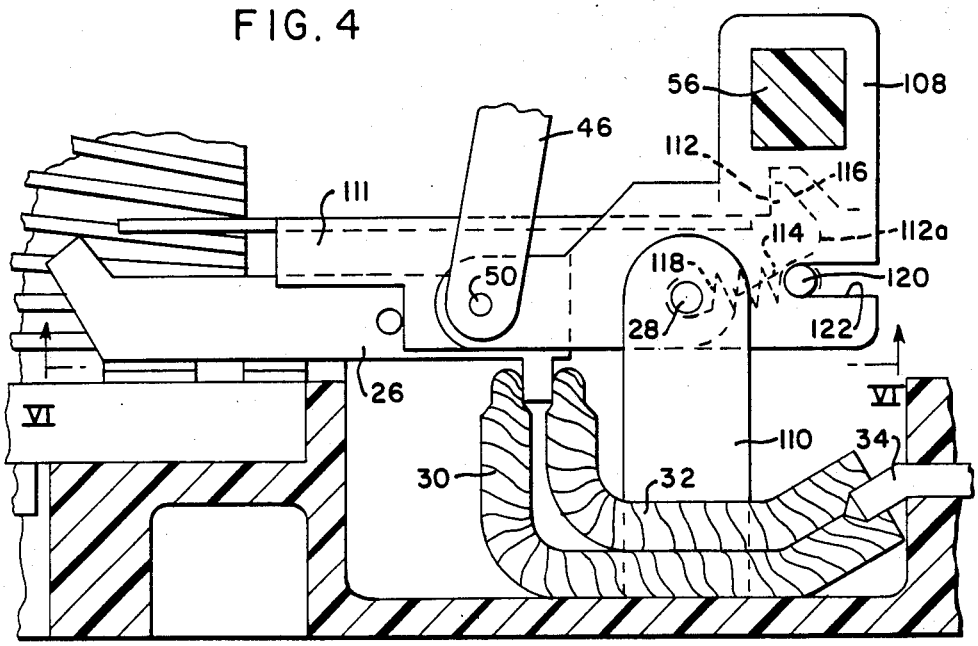
FIG. 4 is an enlarged fragmentary view of FIG. 1 showing the arm latch of this invention.
Figure 5:
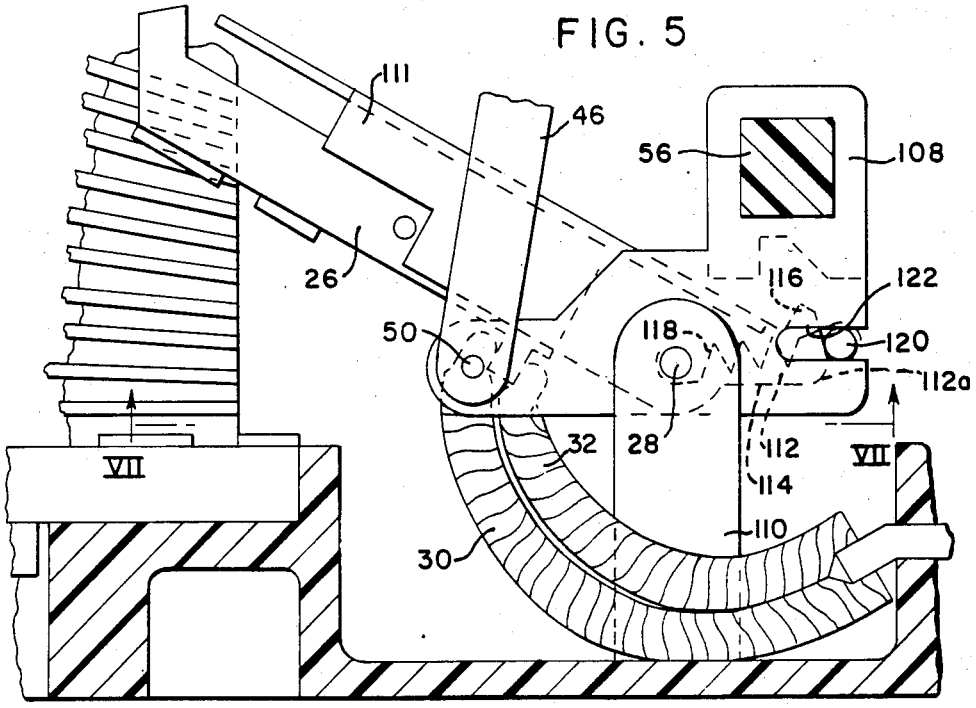
FIG. 5 is an enlarged fragmentary view of the arm latch as shown in FIG. 2.
Figure 6:
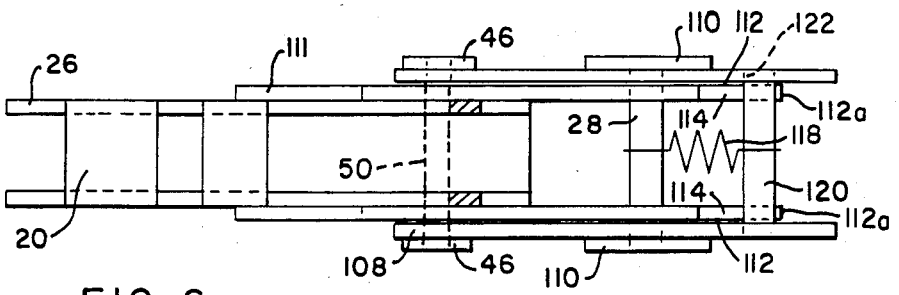
FIG. 6 is a fragmentary sectional view, taken on the line VI—VI of FIG. 4.
Figure 7:
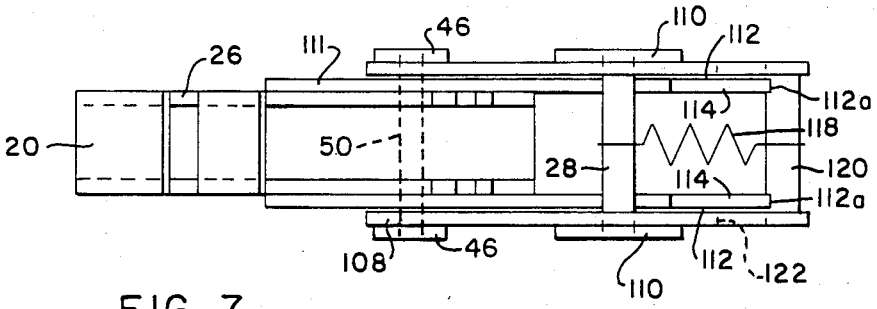
FIG. 7 is a fragmentary sectional view, taken on the line VII—VII of FIG. 5.

As shown in FIGS. 4 and 5 the pin 28 is a pivotal point for rotation of a contact arm assembly and a mounting bracket 108 with the pin being supported between a pair of similar frame members 110 (FIGS. 6, 7). The contact arm assembly includes the contact arm 26 and a switch arm 111 which is an inverted channel member and within which the contact arm is disposed. In effect the assembly of the contact arm 26 and the switch arm 111 comprise the operating contact arm. The switch arm 111 is pivotally mounted on the pin 28 on which it is independently rotatable with the mounting bracket 108. Latching means are provided between the switch arm and the bracket for releasably maintaining them together for simultaneous or separate movement.

The latching means (FIGS. 4–7) include similar cams 112 on the ends of each spaced flange forming the channel switch arm 111. The cams 112 include cam surfaces 114 and 116 which form a nose 112*a* of each cam.

The latching means also includes spring bias means comprising a coil spring 118 and a cam follower or pin 120. End portions of the pin 120 are disposed in similar slots 122 in opposite sides of the mounting bracket 108. The pin 120 is slidably movable within the slots (FIGS. 4, 5) where it is retained by the spring 118 which extends between and is secured to pins 28 and 120.

Figure 2:
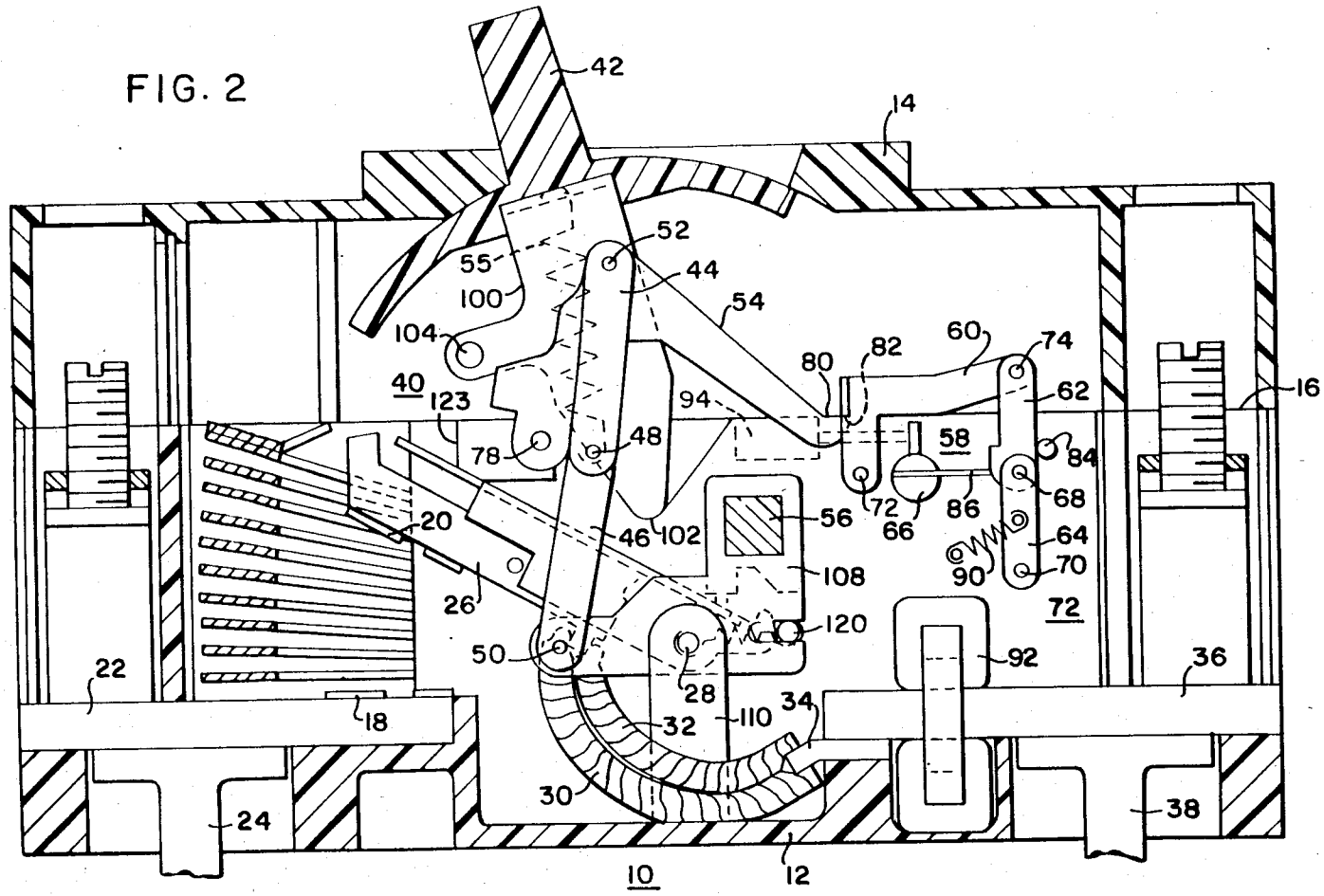
FIG. 2 is a vertical sectional view of the circuit breaker in the "blown open" position.

According, when a short circuit passes through the circuit breaker 10, a repulsion magnetic force of increased value blows the contacts 18, 20 apart, causing the contact arm and switch arm assembly to rotate clock-wise about the pin 28 from the position shown in FIG. 1 to that of FIG. 2 which show the first immediate response to the short circuit current. When the arm opens, a stop 123 on the frame limits the arm from rotating any further.

Figure 3:
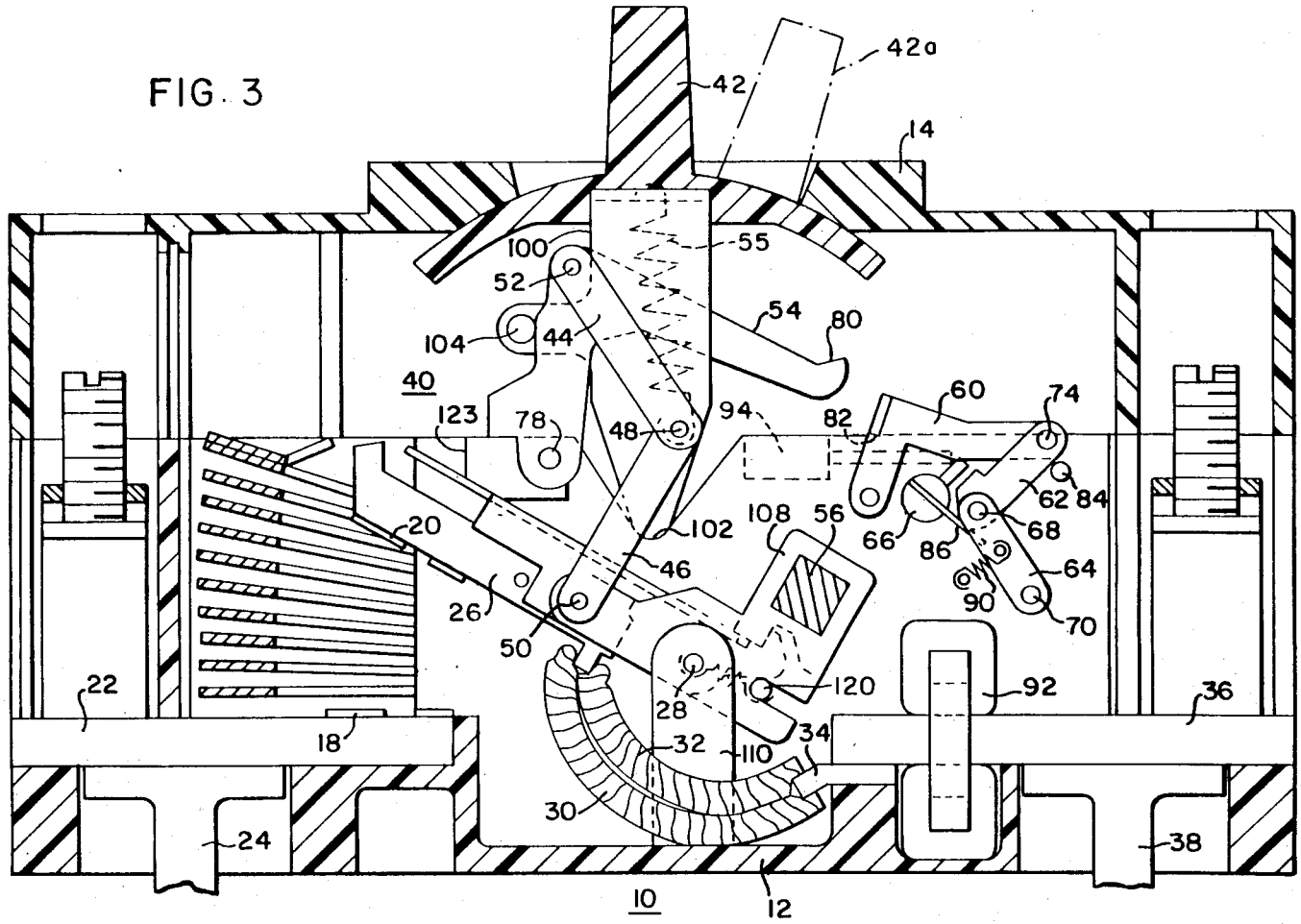
FIG. 3 is a view similar to FIG. 2 with the contacts in the "tripped" position.

Immediately after the contact arm 26 is blown open to the position of FIG. 2, the current transformer 92 actuates the trip device 58 causing the circuit breaker to trip from the position shown in FIG. 2 to that of FIG. 3.

When the contact arm 26 is rotated to the position of FIG. 2, the cam surface 114 bears against the pin 120 causing the pin to move to the right in the slots 122 (FIG. 4) and against the force of the coil spring 118. As the cam 112 continues to move, the pin moves from the nose 112*a* to the cam surface 116 (FIG. 5), whereby the reverse inclination of the surface 116 permits the pin 120 to retract slightly within the slots 122 under pressure of the spring 118. In this manner the cam 112 and the pin 120 cooperate to retain the contact arm 26 in the blown-open position.

After the circuit breaker is tripped to the position shown in FIG. 3, the circuit breaker may be reset by rotating the handle 42 clockwise to a positon 42*a*, causing the pin 104 to bear against the surface 106 of the releasable member or cradle 54 until the end 80 of the cradle is again seated in place beneath the surface 82 of the latch lever 60. Subsequently, the handle 42 is rotated counterclockwise to close the contacts 18, 20 by returning the contact arm 26 to the position shown in FIG. 1, with the latching pin 120 in the original position (FIG. 3) to which it has been returned by operation of the mechanism 40 during movement from the "blown open" position (FIG. 2) to the "tripped" position (FIG. 3).

The circuit breaker of this invention provides for an adjustable blow-open current level and associated built-in latch to hold the contact arms in the blown-open position until the breaker is tripped and its mechanism has opened. Finally, contact arms having a single blow-open pivot permits the moving contact arms of a current limiting circuit breaker to open under short circuit conditions by the use of the same pivot point which also minimizes the wear and breakage of associated shunt members.

What is claimed is:

1. A circuit breaker with blow open contact arm, comprising:

a circuit breaker unit having a pair of separable contacts operable between open and closed positions and including a releasable member;

the contacts sustaining a repulsion magnetic force which force is proportional to the square of the current load flowing through the contacts and which is operable to separate the contacts upon the occurrence of a predetermined current overload;

a trip mechanism movable in respone to the occurrence of a predetermined electric current overload to release the releasable member;

the circuit breaker unit including a contact arm carrying one of the contacts;

mounting means mounting the contact arm for pivotal movement upon actuation of the trip mechanism;

the mounting means including one of a cam and cam follower means for retaining the contact arm in either open or closed positions;

the contact arm including the other of the cam and cam follower means;

the cam follower means moves from a first cam position to a second cam position when the contact arm is propelled to the open contact position in response to a repulsion magnetic force occurring when the current exceeds the predetermined value;

the trip mechanism actuating the circuit breaker unit to the open contact position causing the mounting means to rotate and causing the cam follower means to move to the second cam position from the first cam position;

the cam follower means comprising a cam follower and spring means for holding the cam follower against the cam;

the assembly of the cam and cam follower means is disposed on the side of the pivot opposite the contact;

the cam is on the contact arm and the cam follower means is on the mounting means; and the cam follower means comprising a pin slidable in slot means, said slot means being provided in the mouting means and a coil spring connected to the cam follower means for holding the pin against the cam.

2. A circuit breaker with blow open contact arm, comprising:

a circuit breaker unit having a pair of separable contacts operable between open and closed positions;

the contacts sustaining a repulsion magnetic force that is proportional to the current flowing through the contacts and that operates to separate the contacts upon the occurrence of a predetermined current overload;

a contact arm carrying one of the contacts;

mounting means mounting the contact arm for pivotal movement upon separation of the contacts in response to the occurrence of a predetermined current overload;

the mounting means including one of a cam and cam follower means for retaining the contact arm in either open or closed position;

the contact arm including the other of the cam and cam follower means;

the assembly of the cam and cam follower means being disposed at a location on the end of the arm opposite the contact; and the cam follower means including a pin slidable in slot means, said slot means being provided in the mounting means and partially extending beyond the end of the contact arm, and a spring for urging the pin against the cam.

3. The circuit breaker of claim 2 in which the cam follower means moves from a first cam position to a second cam position when the contact arm is propelled to the open contact position in response to a repulsion magnetic force occurring when the current exceeds the predetermined value.

4. The circuit breaker of claim 3 in which the cam is on the contact arm and the cam follower means is on the mounting means.

* * * * *